5/15/84 XR 4,449,069

United States Patent [19]

Assil et al.

[11] 4,449,069

[45] May 15, 1984

[54] COLOR PICTURE TUBE WITH FOCUSING ELECTRODE HAVING ELECTROSTATIC FIELD DISTORTION APERTURE THEREIN

[75] Inventors: Naim Z. Assil; Richard H. Hughes, both of Lancaster, Pa.

[73] Assignee: RCA Corporation, New York, N.Y.

[21] Appl. No.: 347,526

[22] Filed: Feb. 10, 1982

[51] Int. Cl.[3] ..... H01J 29/51

[52] U.S. Cl. ..... 313/412; 313/414

[58] Field of Search ..... 313/412–414

[56] References Cited

U.S. PATENT DOCUMENTS 3,873,879 3/1975 Hughes ..... 315/13 C

FOREIGN PATENT DOCUMENTS 7809160 9/1978 Netherlands .

*Primary Examiner*—Palmer C. Demeo

*Assistant Examiner*—Sandra L. O'Shea

*Attorney, Agent, or Firm*—Eugene M. Whitacre; Dennis H. Irlbeck

[57] ABSTRACT

An inline electron gun in a color picture tube is improved by the addition of two slot apertures that are spaced sufficiently close to and outward from the two outer apertures in a portion of a focusing electrode facing a screen grid electrode to cause a distortion of the electrostatic field formed between the two electrodes at the two outer apertures. The electrostatic field distortion causes two outer electron beams to converge toward a center electron beam.

4 Claims, 5 Drawing Figures

COLOR PICTURE TUBE WITH FOCUSING ELECTRODE HAVING ELECTROSTATIC FIELD DISTORTION APERTURE THEREIN

This invention relates to color picture tubes having improved inline electron guns, and particularly to an improvement in such guns for reducing the horizontal motion of the outer electron beams caused by variations in the focus voltage applied to the guns.

BACKGROUND OF THE INVENTION

An inline electron gun is one designed to generate or initiate preferably three electron beams in a common plane and direct those beams along convergent paths in that path to a point or small area of convergence near the tube screen. In one type of inline electron gun, such as that shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In such electron guns, static convergence of the outer beams with respect to the center beam is usually attained by offsetting the outer apertures in the second focusing electrode with respect to the outer apertures in the first focusing electrode.

It has been noted that the horizontal beam landing locations of the outer electron beams, in color picture tubes having the above-described electron gun, change with changes in the focus voltage applied to the electron gun. It therefore is desirable to improve such inline electron guns to eliminate or at least reduce this sensitivity to focus voltage changes.

SUMMARY OF THE INVENTION

An inline electron gun in a color picture tube is improved by the addition of two slot apertures that are spaced sufficiently close to and outward from the two outer apertures in a portion of a focusing electrode facing a screen grid electrode to cause a distortion of the electrostatic field formed between the first focusing electrode and the screen grid electrode at the two outer apertures. The electrostatic field distortion causes two outer electron beams to converge toward a center electron beam.

DETAILED DESCRIPTION OF THE PREFERRED EMBODIMENT

Figure 1:
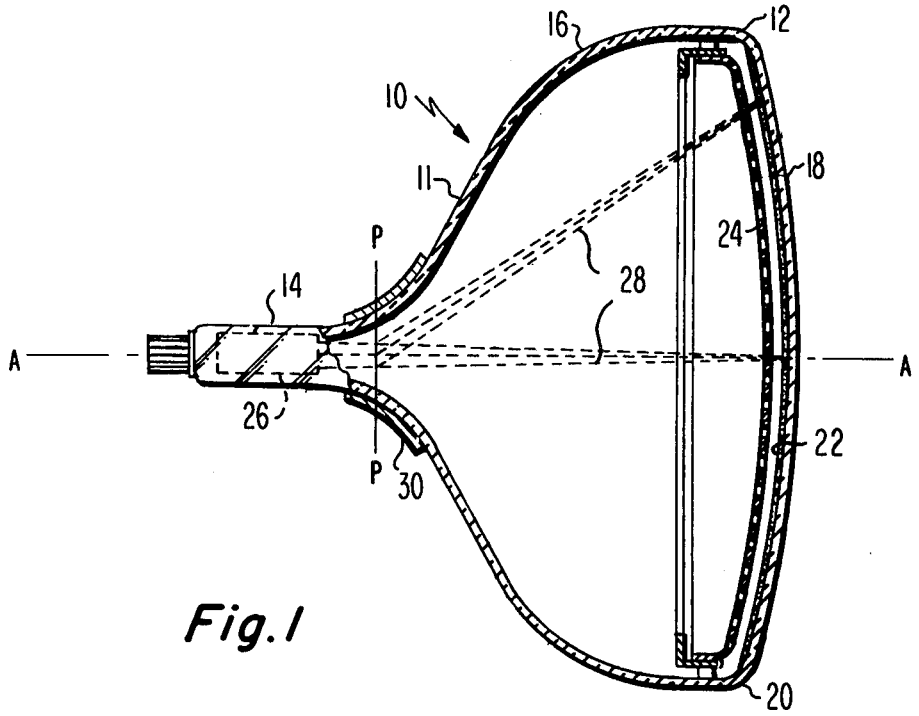
FIG. 1 is a plan view, partly in axial section, of a shadow mask color picture tube embodying the invention.

FIG. 1 is a plan view of a rectangular color picture tube 10 having a glass envelope 11 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 schematically shown surrounding the neck 14 and funnel 12 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P-P in FIG. 1 at about the middle of the yoke 30. For simplicity, the actual curvature of the deflected beam paths in the deflection zone is not shown in FIG. 1.

Figure 2:
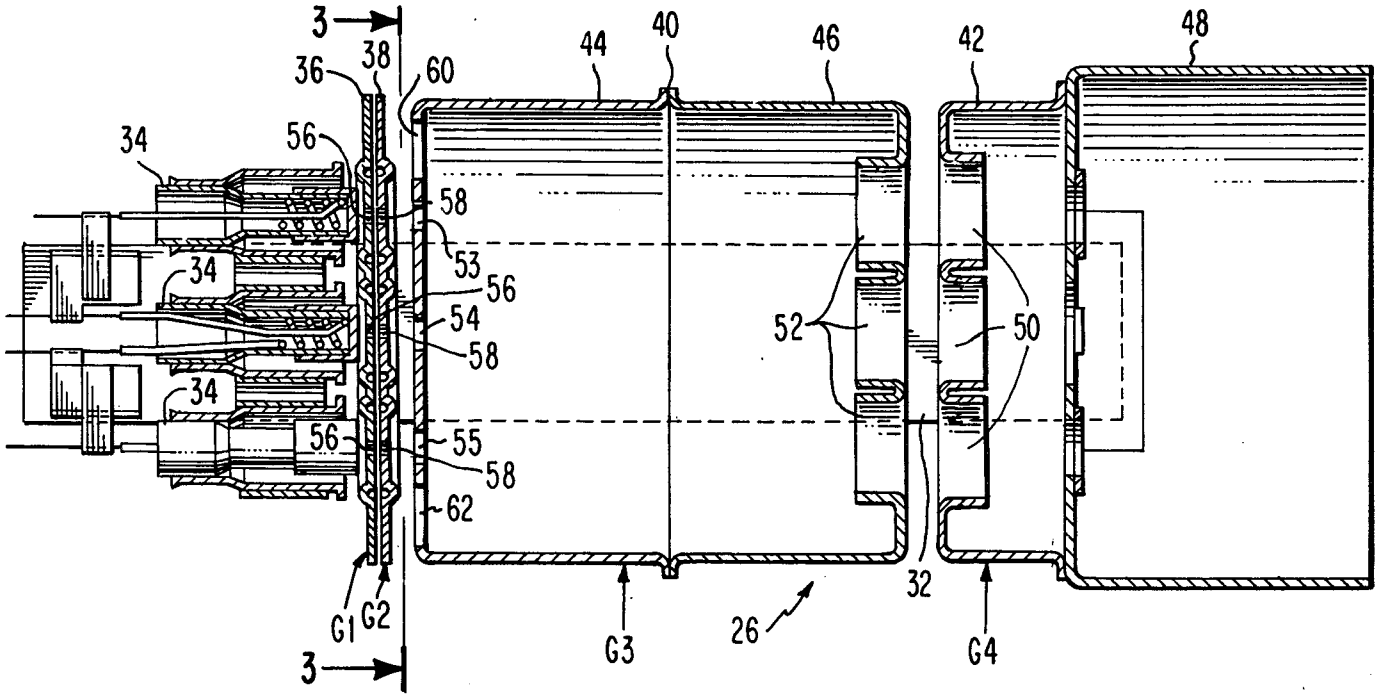
FIG. 2 is a partial axial section view of the electron gun shown in dashed lines in FIG. 1.

The details of the electron gun 26 are shown in FIG. 2. The gun comprises two glass support rods 32 (one shown) on which various electrodes are mounted. These electrodes include three equally spaced coplanar cathode assemblies 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. All of the post-cathode electrodes have at least three inline apertures in them to permit passage of three coplanar electron beams. The main electrostatic focusing lens in the gun 26 is formed between the G3 electrode 40 and the G4 electrode 42. The G3 electrode 40 is formed with two cup-shaped elements 44 and 46, the open ends of which are attached to each other. The G4 electrode 42 also is cup-shaped, but has its open end closed with a shield cup 48. The portion of the G4 electrode 42 facing the G3 electrode 40 includes three inline apertures 50, the outer two of which are slightly offset outwardly from corresponding apertures 52 in the G3 electrode 40. The purpose of this offset is to cause the outer electron beams to converge with the center electron beam. The side of the G3 electrode 40 facing the G2 electrode 38 includes three apertures 53, 54 and 55 which are aligned with apertures 56 in the G1 electrode 36 and with apertures 58 in the G2 electrode 38.

Figure 3:
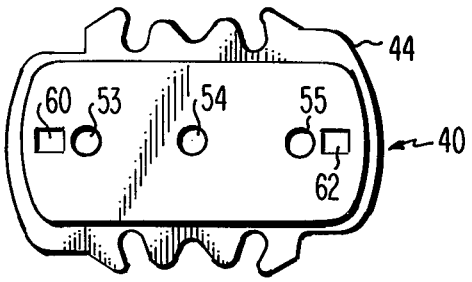
FIG. 3 is an elevational view of a G3 electrode taken at line 3—3 of FIG. 2.

The electron gun 26 is improved by the addition of two rectangular-shaped slot apertures 60 and 62 spaced outwardly from the outer apertures 53 and 55, respectively, in the G3 electrode 40, as shown in FIG. 3. Although the slot apertures 60 and 62 are shown as rectangular in shape, it should be understood that the present invention also includes other shaped slot apertures of other, e.g., oval, elliptical and circular, shapes. The purpose and function of the slot apertures 60 and 62 can be discussed with reference to FIGS. 4 and 5.

Figure 4:
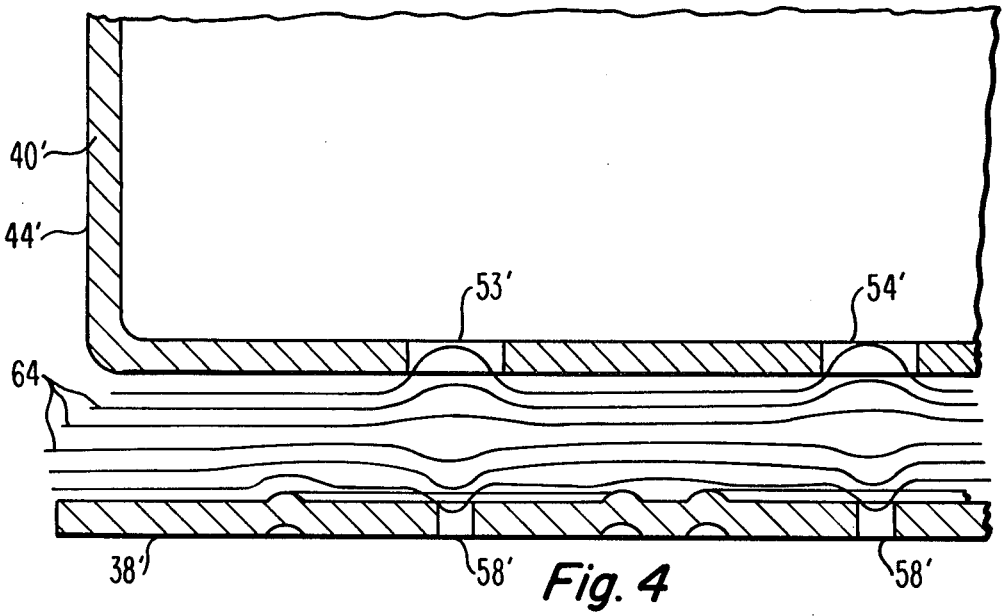
Fig. 4 PRIOR ART
FIG. 4 is an enlarged sectional plan view of portions of the G2 and G3 electrodes in a prior art electron gun, also showing the associated electrostatic equipotential field lines.

FIG. 4 shows the electrostatic equipotential field lines 64 between a G2 screen grid electrode 38' and a G3 focus electrode 40' of a prior art electron gun. (Parts similar to those of the present novel electron gun 26 are designated with a prime of the corresponding numeral.) The field lines 64 at both the outer aperture 53' and the center aperture 54' of the G3 electrode 40' are substantially symmetrical with respect to the center lines of the apertures. Electron beams passing through the centers of the apertures would experience symmetrical forces and would continue along their straight paths.

Figure 5:
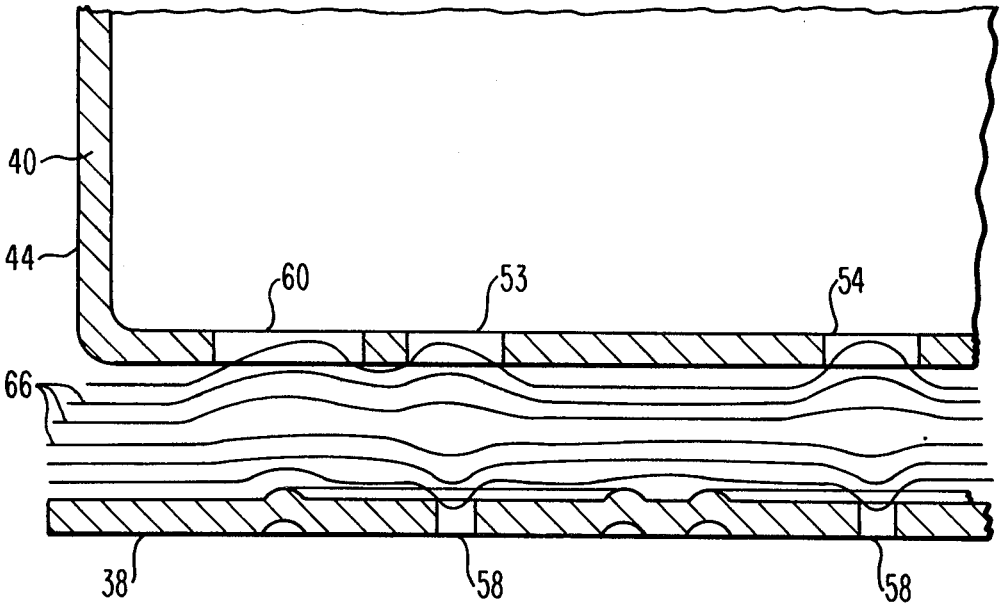
FIG. 5 is an enlarged sectional plan view of portions of the G2 and G3 electrodes of the electron gun of FIG. 2, also showing the associated electrostatic equipotential field lines.

FIG. 5 shows the electrostatic equipotential field lines 66 between the G2 screen grid 38 and the G3 focusing electrode 40 of the novel electron gun 26. Inclusion of the slot aperture 60 outwardly from the outer aperture 53, but closely spaced thereto, causes a distortion of the field lines 66 at the outer aperture 53 of the G3 electrode 40. This distortion results in a shifting of the peak of the field lines at the aperture 53 to the left, as viewed in FIG. 5. Because of this shift, an electron beam passing through the center of the aperture 53 encounters sloped field lines which cause the outer beam to converge toward a center electron beam passing through the aperture 54.

The convergence of the two outer electron beams causes the electron beams to enter the main focusing lens at a slight angle rather than straight on. It has been found that introduction of this angle approach to the focus lens reduces the horizontal motion sensitivity of the center electron beams with respect to focus voltage changes.

Color picture tubes are tested for this sensitivity by varying the focus voltage from minus 1000 to plus 1000 volts relative to the tube's normal operating focus voltage (e.g., 7000 volts), and then measuring the horizontal displacement of the outer electron beams at the tube screen. When such tests were performed on a tube containing a standard RCA "Hi-Pi Electron Gun Mount" designated PI-30R, an average horizontal displacement of 0.812 mm was recorded. In tests on a color picture tube of corresponding size, with the same gun modified by the addition of slot apertures in the G3 electrode as described above, an average horizontal displacement of only 0.137 mm was recorded. The addition of the slot apertures in the G3 electrode thus had a substantial effect on reducing the tube's sensitivity to focus voltage change. In this modified electron gun, slot apertures 2.00 mm (horizontal) by 1.524 mm (vertical) were positioned outwardly from outer apertures of 1.524 mm diameter by a spacing of 0.762 mm.

There are several general considerations that apply in utilizing the present invention. First, as previously noted, the slot apertures must be placed sufficiently close to the electron beam apertures in the G3 electrode so that the electrostatic lenses in the beam apertures are distorted. Generally, the maximum beam aperture-to-slot aperture spacing that can be used in an electron gun such as the PI-30R to attain a significant distortion effect on the electrostatic lens is about 1.50 mm. Spacings beyond this maximum limit have a negligible effect. For example, it is common in electron guns to include alignment apertures in the G3 electrode that are located outward of the beam apertures. In prior art PI-30R type electron guns, 1.27 mm diameter alignment holes were spaced about 1.643 mm from the outer beam apertures. These alignment apertures had negligible effect on the electrostatic lenses of the outer beam apertures. A second consideration is that the beam aperture-to-slot aperture spacing should be great enough to provide sufficient electrode material to block stray electrons and to maintain the structural integrity of beam aperture shapes during tube operation. It has been found that such minimum spacing for a PI-30R type electron gun is about 0.60 mm. A third consideration is that the beam aperture-to-slot aperture spacing as well as the slot aperture size and shape required to attain a desired beam convergence are related to the spacing between the G2 and G3 electrodes. The foregoing dimensions for the PI-30R electron gun apply when the G2 to G3 electrode spacing is 1.22 mm.

What is claimed is:

1. In a color picture tube having an inline electron gun including at least a focusing electrode and a screen grid electrode, said electrodes including a plurality of inline apertures in portions facing each other, the improvement comprising the portion of said focusing electrode facing said screen grid electrode including an additional aperture which is spaced sufficiently close to and outward from an offaxis aperture of the plurality of inline apertures therein to cause a distortion of an electrostatic field formed between said focusing electrode and said screen grid electrode at the offaxis aperture.

2. The tube as defined in claim 1 wherein the spacing between the additional aperture and the offaxis aperture is in the range of 0.60 mm to 1.50 mm.

3. In a color picture tube having an inline electron gun for generating and directing three electron beams along coplanar paths toward a screen of said tube, said gun including at least four spaced electrodes including a control grid electrode, a screen grid electrode, a first focusing electrode and a second focusing electrode, three inline apertures in a portion of said first focusing electrode facing said screen grid electrode, the improvement comprising said first focusing electrode including two slot apertures in said portion facing said screen grid which are spaced sufficiently close to and outward from the two outer apertures in said portion to cause a distortion of an electrostatic field formed between said first focusing electrode and said screen grid electrode at said two outer apertures, whereby the outer two electron beams are converged toward the center electron beam by the electrostatic field distortion.

4. The tube as defined in claim 3 wherein the spacing between each slot aperture and each adjacent outer aperture is in the range of 0.60 mm to 1.50 mm.

* * * * *